United States Patent [19]

Schneider

[11] Patent Number: 4,503,825

[45] Date of Patent: Mar. 12, 1985

[54] DIESEL FUEL SYSTEM

[75] Inventor: Michael J. Schneider, Birmingham, Mich.

[73] Assignee: Bendix Corporation, Southfield, Mich.

[21] Appl. No.: 364,812

[22] Filed: Apr. 2, 1982

[51] Int. Cl.[3] ..... F02M 39/00

[52] U.S. Cl. ..... 123/446; 123/501; 123/458; 239/95

[58] Field of Search ..... 123/500, 501, 502, 446, 123/458; 239/88, 89, 90, 91, 92, 93, 94, 95

[56] References Cited

U.S. PATENT DOCUMENTS

| | | | |
|---|---|---|---|
| 4,235,374 | 11/1980 | Walter | 123/500 |
| 4,281,792 | 8/1981 | Sisson | 123/502 |
| 4,378,774 | 4/1983 | Kato | 239/88 |
| 4,385,609 | 5/1983 | Kato | 123/446 |
| 4,396,151 | 8/1983 | Kato | 239/95 |
| 4,402,456 | 9/1983 | Schneider | 239/95 |

*Primary Examiner*—Charles J. Myhre
*Assistant Examiner*—Carl Stuart Miller
*Attorney, Agent, or Firm*—Markell Seitzman; Russel Wells

[57] ABSTRACT

A diesel fuel system including a cam actuated unit injector employing a single control valve controlling the establishing and disestablishing of a hydraulic link in a timing chamber between a driven piston and a metering piston. The cam is configured to temporarily halt the upward motion of the pumping piston during a fuel metering period and until the disestablishment of the hydraulic link.

7 Claims, 2 Drawing Figures

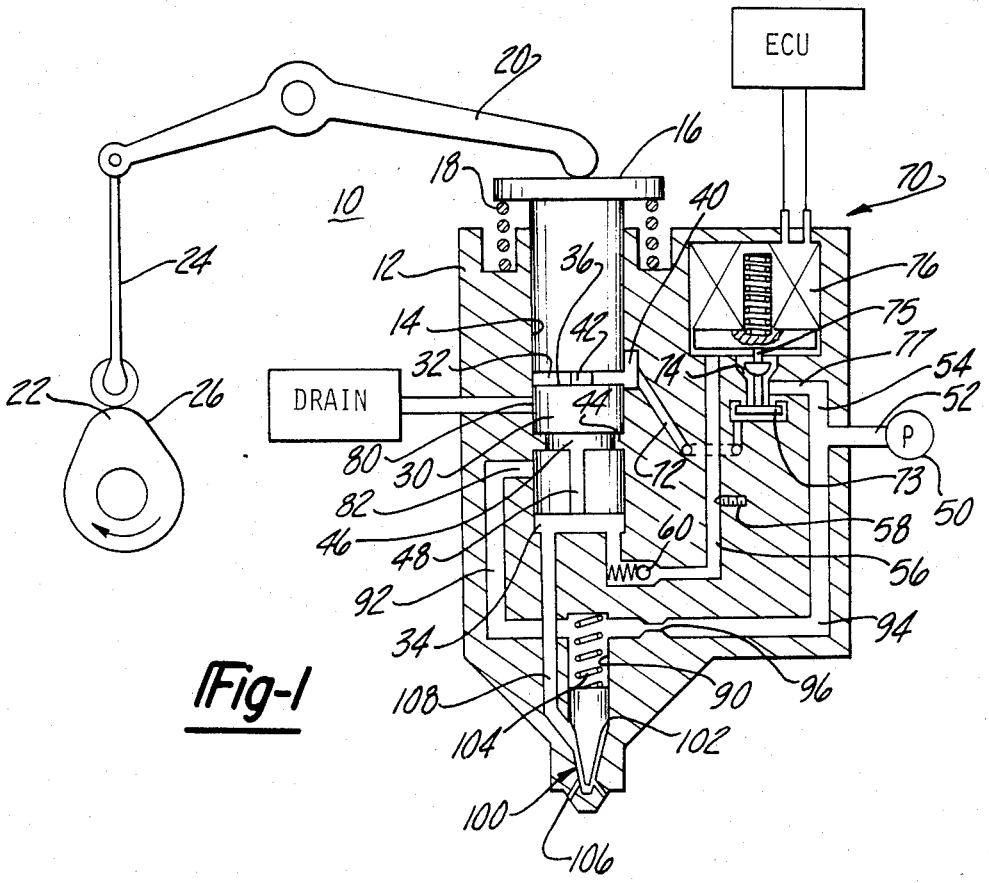
Fig-1
Fig-2
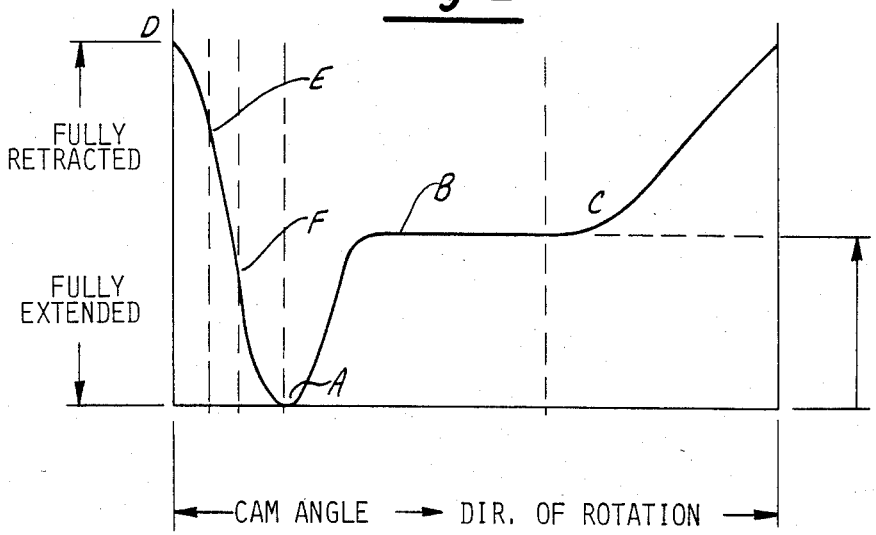

DIESEL FUEL SYSTEM

CROSS-REFERENCE TO RELATED PATENT APPLICATION

This application is related to the co-pending application Ser. No. 282,629 by Sisson et al filed July 13, 1981.

BACKGROUND AND SUMMARY OF THE INVENTION

This invention relates generally to fuel injection systems for diesel engines and more particularly to engine driven unit injectors defining a metering chamber and operable in a pressure-time method of fuel metering.

U.S. Ser. No. 282,629 filed July 13, 1981 discloses a fuel system having a unit injector which includes a single electrically controlled solenoid that controls each of the functions of timing and the quantity of fuel that is permitted to enter a metering chamber defined within the unit injector prior to the moment of initiating fuel injection into the diesel engine. The control valve is controlled by an electronic control unit (ECU) of a known variety such as that described in Ser. No. 945,988 filed Sept. 25, 1978 which is incorporated herein by reference. The Sisson et al fuel injector includes a fixed yet adjustable orifice within the fuel line leading to the metering chamber. The incorporation of the orifice within the fuel line or passage permits the regulation of the amount of fuel entering the metering chamber in proportion to the pressure drop across the adjustable orifice and the time during which fuel is permitted to flow into the metering chamber. Consequently the above utilized method of fuel metering has been referred to as a pressure-time method of fuel metering. As disclosed in U.S. Ser. No. 282,629, when the pumping piston is retracted quickly a vapor is created in the timing chamber which is located between the pumping piston and a reciprocal metering piston. The metering piston floats freely within its sleeve or bore while a controlled quantity of fuel is allowed to enter the metering chamber which is defined between the metering piston and the lower end of the sleeve or bore. To prevent the metering piston from rising excessively, that is, from moving toward the pumping piston, it has been suggested to incorporate mechanical stops to limit the maximum extent of the upward motion of the metering piston. If the metering piston is permitted to rise in an uncontrolled manner, it may contribute to premature fuel injection into the engine and permit an excessive amount of fuel to enter the metering chamber which upon subsequent injection into the engine will contribute to excessive smoke and noxious exhaust fumes. The present invention utilizes a unique cam profile that allows the cam driven pumping piston to be stopped during the retraction portion of its operating cycle. In addition, the present invention utilizes the pumping piston as a physical stop thereby preventing excess travel of the metering piston during the metering portion of operation.

The major disadvantages of including a mechanical stop such as a pin and the like for limiting the upward motion of the metering piston are that the manufacturing cost of the piston and its housing are increased; the reliability of a mechanical pin is questionable since they are prone to break and the incorporation of pins within a unit injector normally requires that the size of the metering piston be increased thereby increasing the overall size of the injector. In addition, the incorporation of a pin may require that the metering chamber be increased substantially which may have a degrading effect upon performance because of the increased compressible volume of the fuel within the now larger metering chamber.

Accordingly, the present invention comprises:

a housing having a bore, a pumping piston situated within the bore; means for reciprocating the pumping piston in synchronism with the engine; a metering piston situated within the bore below the pumping piston; a timing chamber situated between the pistons; a metering chamber situated below the metering piston; a nozzle connected in fluid connection with and located remote from the metering chamber; control valve means in communication with (a) a source of fuel, (b) the timing chamber for opening and closing the timing chamber at a determinable point during the extending motion of the pumping piston to establish and disestablish a hydraulic link between the pumping piston and the metering piston to initiate fuel injection, and with (c) the metering chamber for permitting fuel to flow into the metering chamber after the time that said pumping plunger has begun its retracting motion. The invention further comprising a plurality of fluid passages interconnecting the control valve means, the pressure source, the timing chamber and the metering chamber; wherein the retracting motion of the pumping piston is halted at a determinable position in its upward travel during the time that fuel is permitted to flow into the metering chamber, and wherein the pumping piston is maintained at this determinable position until the time that the timing chamber is opened to disestablish the hydraulic link.

BRIEF DESCRIPTION OF THE DRAWINGS

In the drawings:

FIG. 1 is a schematic diagram of a cam driven unit injector for a diesel engine.

FIG. 2 illustrates a unique cam profile.

DETAILED DESCRIPTION OF THE DRAWINGS

Reference is made to FIG. 1 which shows the preferred embodiment of the present invention. FIG. 1 illustrates a unit injector 10 in its metering phase of operation. The unit injector 10 comprises a housing shown generally as 12. The housing incorporates a bore 14 that contains a reciprocal cam driven pumping piston 16. The pumping piston is urged upwardly by a heavy duty spring 18 that is biased against portions of the housing 12. The pumping piston 16 is driven downwardly by a rocker arm 20 that is moved by a cam 22 and cam follower 24. The cam 22 contains a predetermined outer contour or cam profile 26 that is illustrated in FIG. 2.

The unit injector 10 further includes a metering piston 30 that is similarly reciprocally mounted within the bore 14. The volume between the pumping piston 16 and the metering piston 30 defines a timing chamber 32. The volume below the metering piston 30 and the lower end of the bore 14 defines a metering chamber 34. Pressurized fuel is received from a supply pump 50 at the supply port 52. Fuel is transported via internal passages 54 and 56 to the metering chamber. An electrically operated control valve 70 selectively controls the flow of fuel from passage 54 to passage 56. Passage 56 may further include an adjustable orifice 58 and does include a check valve 60. The check valve 60 is connected to prevent the reverse flow of fuel from the metering chamber towards the supply pump 50. Pressurized fuel is selectively allowed to flow from the supply port 52 to the timing chamber 32 through the control valve 70 and the internal passages 72.

The control valve 70 further includes a high pressure port 73, a low pressure port 74, a movable armature 75, coil 76 and return spring 77. In response to an energization signal received by the coil 76, the armature 75 is moved upwardly to close off the high pressure port 73 and to open the low pressure port 74. This condition is illustrated in FIG. 1. By closing off the high pressure port 73, the fuel within the timing chamber 32 is trapped therein and a hydraulic link is established between the pumping piston 16 and the metering piston 3. By virtue of this hydraulic link the metering piston will attempt to follow the motion of the pumping piston. With the solenoid valve 70 in the condition as illustrated in FIG. 1, the low pressure port 74 leading to the metering chamber is open. During a later portion of the operating cycle of the injector 10, the activation signal applied to the control valve 70 is removed, consequently the armature will be repositioned to close off the low pressure port 74 by virtue of the biasing force received from the spring 77.

To prevent the pumping piston 16 from closing off the passage 72 leading to the timing chamber 32 during the dwell portion of the motion of the pumping piston as later described, the bore 14 is fabricated with a cutout or slot 40. In addition, to prevent the metering piston and pumping piston 16 from compacting over a large surface area, the pumping piston further includes an extending portion 42 that controls the minimum spacing between the two pistons.

The unit injector 10 further includes means for relieving, porting or dumping the pressure within the timing and metering chambers 30 and 34 respectively in correspondence with the motion of the metering piston. The unit injector includes a timing chamber dump port 80 which is connected to a low pressure drain or source such as the fuel reservoir or fuel tank. The timing chamber dump port 80 is fabricated in the walls of bore 14. As will be described later, when the upper surface 36 of the metering piston 30 is moved below the uppermost portion of the timing chamber dump port 80, the pressurized fuel within the timing chamber 32 is thereafter dumped to drain. The unit injector further includes a metering chamber dump port 82 which is connected with a spring cage or bore 90 through a passage 92. The spring cage or bore 90 is connected via passage 94 to the supply port 52. The passage 94 may optionally include a vent orifice 96. The metering piston 30 includes an annulus 44, cross-hole 46, and axial passage 48. The positioning of the annulus 44 adjacent to the metering chamber dump port 82 permits the communication between the metering chamber 34 and dump port 82. There are several ways of implementing dump ports. As an example, alternate means for connecting the metering chamber to the dump port 82 could replace the cross-hole 46 and axial passage 48 with a dump annulus (not shown) situated in the lower portion of the bore 14. Communication between the metering chamber 34 and dump port 82 would be accomplished through the interaction of the dump annulus (not shown) and the annulus 44.

The unit injector further includes a nozzle 100 of known construction, remotely situated from the metering chamber 34. The nozzle 100 includes a movable valve such as a needle valve 102 which is biased by a spring 104 during non-injecting periods to close the flow orifices 106. The spring 104 is situated within the spring cage 90. Fuel is communicated from the metering chamber to the needle valve via a passage 108. The upper portion of the needle valve 102 is maintained in a fluid tight engagement with the body 12 to prevent fuel from flowing from passage 108 and the spring cage 90.

Reference is made to FIG. 2 which illustrates the cam profile 26 of the present invention. This cam profile is helpful in understanding various operating modes of the present invention. The present invention contains four phases of operation: (1) an injection phase wherein the predetermined quantity of fuel that has been premetered to the metering chamber 34 is injected into the engine; (2) the dumping phase during which the metering piston is positioned to uncover the timing chamber and metering chamber dumping ports 80 and 82, respectively, thereby controllably relieving the pressure within the timing chamber 32 and in the metering chamber 34; (3) a metering phase of operation during which the pumping piston 16 is retracted and fuel is permitted to flow into the metering chamber 34 therein moving the metering piston 30 upwardly; and (4) a timing phase of operation during which the pumping piston first moves upwardly and then moves downwardly but during which the position of the metering piston 30 remains at its equilibrium position established at the end of the metering phase of operation.

Turning now to a discussion of the metering phase of operation. The metering phase of operation begins with the pumping piston 16 in its fully downward extended position (point A of FIG. 2) and with the metering piston 30 in its most downward position. During the metering phase of operation, the control valve 70 is maintained in a condition to close off the high pressure port 73 and to correspondingly open the low pressure port 74 such that fuel from the supply 50 can flow into the metering chamber 34. During this phase of operation the cam profile 26 permits the pumping piston 16 to retract upwardly to a mid-stroke position (point B) such that the pumping piston 16 uncovers a portion of the slot 40. As the pumping piston 16 withdraws from its fully extended position, it creates a vapor pocket within the timing chamber 32. The pressure within the metering chamber 34 and the timing chamber 30 are reduced to the vapor pressure of the fuel. This reduction of pressure causes the check valve 60 to open and permit fuel to flow from the supply 50 into the metering chamber 34. The metering piston 30 will move upwardly until the control signal to the solenoid permits the armature 75 to close off the low pressure port 74 or until the metering piston rises to its maximum extent and impacts the extension 42 on the lower surface of the pumping piston 16. It is significant that the dwell position of the pumping piston 16, during this metering phase of operation, be positioned such that the passage 72 is communicated to the timing chamber 32. This is accomplished, as mentioned above, by permitting the pumping piston 16 to be positioned so that the extending portion 42 is opposite at least a portion of the slot 40. In addition, the dwell position of the timing piston 16 must be such that the upward motion of the metering piston 30 be limited to a maximum value such that the metering chamber 34 is not communicated to either the timing chamber dump port 80 or to the metering chamber dump port 82. Once it has been established by an electronic control unit (ECU) that the requisite amount of fuel has entered the metering chamber 34, the control unit removes the solenoid valve activation signal therein causing the solenoid 70 to close the low pressure port 74 and communicate the timing chamber 32 to the supply 50 through the high pressure port 73. Simultaneously with the opening of the high pressure dump port or thereafter, the cam profile 26 causes the pumping piston 16 to again move upwardly (point C) to its fully retracted position (point D). The opening of the high pressure dump port 73 initiates the beginning of the timing phase of operation. During this timing phase, as previously mentioned, the timing chamber 32 is communicated with the supply 50. The position of the metering piston 30 established during the metering phase of operation is unaffected by the continued upward motion of the pumping piston 16 by virtue of the communication of the timing chamber 32 to the supply 50. Upon reaching its fully retracted position (point D) the cam 22 will cause the pumping piston 16 to be extended into the bore 14. During the downward motion of the pumping piston 16, the fuel resident in the timing chamber 32 will be forced therefrom toward the supply 50 since the high pressure port 73 is maintained in an open condition.

In response to the engine operating conditions and correspondence with the combustion process of a corresponding cylinder of the diesel engine, the solenoid 70 is activated to thereafter close off the high pressure port 73 therein establishing a hydraulic link between the pumping piston 16 and the metering piston 30. The continued downward extension of the pumping piston 16 causes the metering piston 30 to compress the fuel within the metering chamber 34 and at a predetermined magnitude of pressure established by the bias force exerted by the spring 104 upon the needle valve 102. The needle valve, due to the increased fuel pressure within the metering chamber 34, is unseated and the injection phase begins. The initiation of the injection phase of operation corresponds to point E of FIG. 2.

After the initiation of injection the metering piston 30 is moved further downward by the continued downward motion of the pumping piston 16. By virtue of this continued downward motion of the metering piston 30, its upper surface 36 will uncover the timing chamber dump port 80 therein communicating the timing chamber to drain thus relieving the fuel pressure therein. In addition, the annulus 44 of the metering piston 30 will uncover the metering chamber dump port 82 and communicate the metering chamber via the cross-hole 46 axial passage 48, passage 92, spring cage 90, orifice 96, and passage 94 to the supply 50. During this dumping phase of operation, the beginning of which corresponds to point F of FIG. 2, the pumping piston 16 is urged downwardly to its fully extended position. The injector 10 is now positioned to enter a subsequent metering phase of operation.

Many changes and modifications in the above-described embodiment of the invention can, of course, be carried out without departing from the scope thereof. Accordingly, that scope is intended to be limited only by the scope of the appended claims.

What is claimed is:

1. In combination a cam driven fuel injector of the type employing a pressure-time method of metering fuel to a metering chamber and cam means for causing the fuel injector to periodically inject quantities of fuel therefrom, the fuel injector of the type having a reciprocal pumping piston situated within a bore and a reciprocal metering piston similarly lodged within said bore, the volume between the pumping piston and the metering piston forming a timing chamber therebetween and wherein the volume below the metering piston and above the lower end of the bore forms a metering chamber; the fuel injector further including a nozzle remotely located from said metering chamber and a plurality of fluid carrying passages for receiving pressurized fuel and for distributing the pressurized fuel to the metering chamber and timing chamber from a source of fuel; the fuel injector further including dumping means for relieving the presssure in the timing chamber and the metering chamber in correspondence with the motion of said metering piston the fuel injector further including electronically controlled valve means for closing off a fluid passage between the timing chamber and the supply during the interval of time that the pumping piston is moving downwardly therein establishing a hydraulic link between the metering piston and the timing piston and for permitting fuel to flow from the supply to said metering chamber through another one of the fuel passages having an adjustable orifice means during that portion of the injector operating cycle characterized by the retracting motion of the pumping piston, the improvement comprising wherein the cam means includes a means for delaying the retracting motion of the pumping piston during the period of the operating cycle where fuel is flowing into the metering chamber thereby urging the metering piston upwardly such that the pumping piston operates as a mechanical stop to prevent excessive upward motion of the metering piston.

2. An apparatus comprising: p1 a housing having a bore;

a pumping piston situated to within said bore;

means for reciprocating said pumping piston in synchronism with the engine;

a metering piston situated within said bore below said pumping piston;

a timing chamber situated between said pistons;

a metering chamber situated below said metering piston;

a nozzle connected in fluid communication with and located remote from said metering chamber;

control valve means in communication with (a) a source of pressurized fuel (b) said timing chamber for opening and closing said timing chamber at a determinable point during the extending motion of pumping piston to establish and disestablish a hydraulic link between said pumping piston and said metering piston to initiate fuel injection, and (c) in communication with said metering chamber for permitting fuel to flow into said metering chamber after the time that said pumping plunger has begun its retracting motion;

a plurality of fluid passages interconnecting said control valve means, said pressure source, said timing chamber and said metering chamber; wherein said reciprocating means halts the retracting motion of said pumping piston at a determinable position in its upward travel during the time that fuel is permitted to flow into said metering chamber, and wherein said pumping piston is maintained at said determinable position until the time that said timing chamber is opened to disestablish said hydraulic link.

3. The apparatus as defined in claim 2 further including an adjustable orifice lodged in one of said plurality of fuel passages leading to said metering chamber.

4. The apparatus as defined in claims 2 or 3 wherein said determinable position is such as to communicate said timing chamber with said control valve means.

5. A method of operating a fuel injector disposed in operative relationship to a combustion chamber of an internal combustion engine, said injector including the housing having an axially extending bore, a pumping piston and a metering piston positioned therewithin for axial movement, a nozzle situated at one end of the housing remote from the pumping piston, a timing chamber defined in said housing between said pumping piston and said metering piston, a metering chamber defined in said housing between said metering piston and said nozzle, passages for introduction of fuel into said chambers, and control means situated proximate said passages and said timing chamber, said method comprising the steps of:

introducing fuel at supply pressure to said passages and said chamber;

applying force to the pumping piston to extend said pumping piston into the bore;

operating the control valve to conceal the timing chamber and form a hydraulic link between the pumping piston and the metering piston during the advancing motion of the primary piston and thereafter moving said pumping piston and said metering piston in concert;

discharging fuel in the metering chamber through the nozzle in response to the operation of the control valve means and the motion of the pumping piston;

retracting the pumping piston to a determinable position in its upward travel permitting fuel to enter the metering chamber;

halting the retraction motion of the pumping piston at a determinable position in its upward travel while fuel is permitted to enter the metering chamber;

causing the control valve means to open a passage to the timing chamber and to close a passage to the metering chamber prior to the time that the pumping piston assumes its fully retracted position;

retracting the pumping piston to its fully retracted position and terminating the operation of the control valve means to open the timing chamber and break the hydraulic link between the pumping piston and the metering piston and moving the pumping piston independently of the metering piston.

6. The method of claim 5 further including the step of aligning the timing chamber with a passage connecting to the control valve means during the time when the pumping piston is maintained at the determinable position.

7. The method of claim 6 further including the step of filling the metering chamber to a determinable level during the interval of time that the pumping piston is halted such that said metering piston is moved in contact with the pumping piston.

* * * * *